US009395149B2

(12) United States Patent
Balgaard

(10) Patent No.: US 9,395,149 B2
(45) Date of Patent: Jul. 19, 2016

(54) ROTATING STOCK BUTT AND SIGHTING BEAD

(71) Applicant: Stanley James Balgaard, Evansville, MN (US)

(72) Inventor: Stanley James Balgaard, Evansville, MN (US)

( * ) Notice: Subject to any disclaimer, the term of this patent is extended or adjusted under 35 U.S.C. 154(b) by 0 days.

(21) Appl. No.: 14/534,142

(22) Filed: Nov. 5, 2014

(65) Prior Publication Data

US 2016/0123697 A1 May 5, 2016

(51) Int. Cl.
*F41C 23/14* (2006.01)
*F41C 23/08* (2006.01)
*F41C 23/04* (2006.01)

(52) U.S. Cl.
CPC ..... *F41C 23/08* (2013.01); *F41C 23/14* (2013.01); *F41C 23/04* (2013.01)

(58) Field of Classification Search
CPC ..... F41C 23/14; F41C 23/04
USPC ..... 42/71.01, 72, 75.01, 75.04, 73, 148, 74, 42/139
See application file for complete search history.

(56) References Cited

U.S. PATENT DOCUMENTS 1,088,362 A * 2/1914 Perkins ..... F41C 23/08 42/73
1,651,299 A * 11/1927 Stansel ..... F41C 23/14 42/73
2,066,218 A * 12/1936 Morgan ..... F41C 23/14 42/73
2,613,442 A * 10/1952 Austin ..... F41G 1/18 42/139
2,787,855 A * 4/1957 Guymon ..... F41C 23/14 42/73
3,434,213 A * 3/1969 Lauder ..... F41G 1/473 42/139
5,009,021 A * 4/1991 Nelson ..... F41C 23/20 42/73
5,367,812 A * 11/1994 Lautrec ..... F41C 23/14 42/72
5,918,374 A * 7/1999 Campbell ..... F41G 1/033 42/124
5,970,642 A * 10/1999 Martin ..... F41C 23/14 42/73
8,720,099 B1 * 5/2014 Sisk ..... F41C 23/14 42/73
2003/0079394 A1 * 5/2003 Poff, Jr. ..... F41C 23/06 42/74
2003/0221352 A1 * 12/2003 Steele ..... F41C 23/14 42/73
2005/0241205 A1 * 11/2005 Rotundo ..... F41C 23/14 42/71.01
2005/0268516 A1 * 12/2005 Nelson ..... F41G 1/00 42/73
2007/0214697 A1 * 9/2007 Ochoa ..... F41C 23/14 42/73
2008/0028662 A1 * 2/2008 Abraham ..... F41C 23/14 42/73
2013/0036650 A1 * 2/2013 Larue ..... F41G 11/003 42/148
2013/0174465 A1 * 7/2013 Martinez Martinez . F41G 1/033 42/139
2014/0109453 A1 * 4/2014 Paquette ..... F41C 23/14 42/73

* cited by examiner

*Primary Examiner* — Samir Abdosh
*Assistant Examiner* — John D Cooper

(57) ABSTRACT

A mechanism, which may be integral with the gun parts and which permits the butt of a shouldered firearm, that either shoots shot or projectiles, to be pivoted about an axis, or which is integral to the gun parts whereby the stock butt is pivoted by design and fixed in place, or which may be manufactured as an after-market item, and which permits the butt of a shoulder-fired gun to be pivoted about a central point. This final design only applies to any shouldered firearm where firing mechanism, barrel, and sighting device are elevated above stock butt.

9 Claims, 5 Drawing Sheets

ROTATING STOCK BUTT AND SIGHTING BEAD

CROSS-REFERENCE TO RELATED APPLICATIONS

Not Applicable

BACKGROUND OF THE INVENTION

Traditionally, when aiming a shouldered firearm, the shooter brings the gun to the shoulder and tilts and rotates the head into the stock to enable the shooter to see down the barrel mounted sight to the intended target. This movement prohibits the shooter from squaring his head vertically and horizontally with the target. The shooter forfeits the natural stance of directly facing the target and of keeping the head fixed and still in the gun mount. This extra movement leaves room for increased error. Additionally, it has been long understood that the less movement required by the shooter while acquiring the sight results in greater accuracy when shooting. It is also widely accepted that the better the gun fits the user, the better it lends itself to greater comfort, also leading to greater accuracy when shooting.

This invention, which was created for use in hunting and sporting, allows the gun to rise and rotate in front of the shooter's eye by a rotation of the stock thereby letting the shooter align the eye with the sight of the gun without having to tilt or rotate the head. This allows the shooter to directly face the target, keeping the head still while mounting the gun, leading to minimal movement, greater accuracy, and a natural gun mount. This is of special advantage to those who shoot with both eyes open in that it allows for an accurate depth of perception. This invention can be incorporated into the design of any shouldered firearm in which the stock is held against shoulder and the stock is lower than the barrel. Existing stock butts may also be adapted to feature this modification by attaching the aftermarket adjustable rotating recoil shoulder pad.

BRIEF SUMMARY OF THE INVENTION

It is a benefit of the present invention to allow the barrel and sighting device to remain elevated above the stock butt, and provides a means whereby the firing mechanism, barrel, and sighting device can be set at different degrees to the left or to the right of the vertical center of the stock butt.

This invention gives the user the advantage of the barrel and sighting mechanism being directly placed in front of the user's eye while the head is substantially perpendicular to the target This invention gives the shooter the further benefit of having both eyes perpendicular with the target, allowing equal depth of perception; this is useful to all shooters, but gives the greatest advantage to the shooter that shoots with both eyes open.

Another benefit of this invention is very little to no head movement in the gun mount.

A further benefit of this invention is lengthening and shortening the stock butt.

Yet another benefit of this invention is raising and lowering the shoulder recoil pad.

Still a further benefit of this invention is adjusting the sighting bead to maintain top center when the firing mechanism and barrel are offset at different degrees.

DETAILED DESCRIPTION OF THE INVENTION

This description depicts only typical embodiments of the invention, and is not intended to be limiting of its scope.

Figure 1:
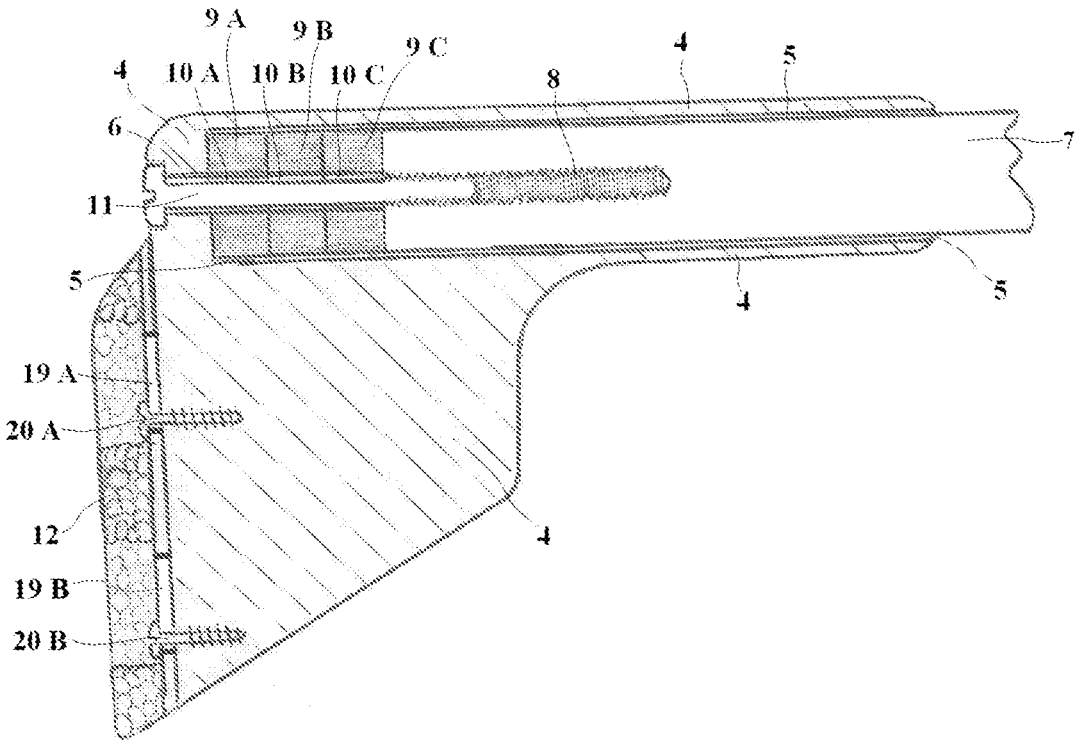
FIG. 1: sectional view of adjustable gun butt that contains multiple units. The gun butt is shown divided in the middle with the facing side removed.

As seen in FIG. 1, a shouldered firearm includes a second member of adjustable gun butt 4, with a large opening 5 and then a reduced opening 6. The gun butt leads to the forward portion of the first member of the adjustable gun butt 7, to which this invention primarily applies.

Spacers 9*abc* fit into the gun butt opening 5 to allow the shooter to adjust the length of the stock 7. The fastener 11 travels through the reduced opening 6 of gun butt 4 and the spacer openings 10*abc* as needed, and fastens into the threaded opening 8 in the rearward portion of the first member of the adjustable gun butt 7. When the fastener 11 is loosened, the first member of adjustable gun butt 7 can be adjusted into the desired position. When the fastener 11 is tightened, it holds the second member of the adjustable gun butt 4 and the first member of adjustable gun butt 7 securely together.

Further, FIG. 1 displays the adjustable recoil shoulder pad 12 fastened to the rearward portion of the second member of adjustable gun butt 4. Elongated vertical openings 19*ab* in the recoil shoulder pad 12 allow the recoil shoulder pad to be adjusted upward or downward to suit the shooter, and also allow fasteners 20*ab* traveling through the recoil shoulder pad 12 to fasten into the second member of the adjustable gun butt 4. This allows the recoil shoulder pad 12 to be adjusted downward, thereby raising the gun to the shooter's desired position.

Figure 2:
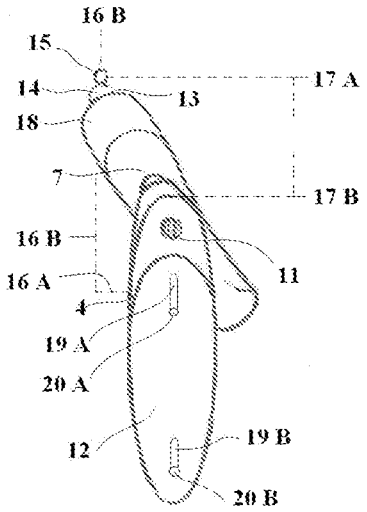
FIG. 2: rear view of a shouldered firearm. This figure includes the stock that has been rotated to the left, showing the stock to be lower than the barrel, firing mechanism and sighting device.

FIG. 2 displays a rear view of a shouldered firearm, showing the forward portion of the first member of adjustable gun butt 7, the rearward portion of the firing mechanism 18 pivoted counterclockwise about an axis, the sighting base 14, and the sighting bead 15 pivoted clockwise about an axis. Once adjusted, the rotating portion is fixed in place by fasteners 11. As pictured, the rotation has caused the firing mechanism 18 the barrel 13, and the sighting bead 15 to be located to the left of the stock, shown by the broken lines of 16*ab*. The sighting bead 15 is attached to a base 14, which allows for adjustment to accommodate the rotation of the firing mechanism 18 and the barrel 13.

FIG. 2 also displays the recoil shoulder pad 12, along with the two elongated vertical slots 19*ab*, which allow for an upward and downward adjustment of the recoil shoulder pad 12, and the fasteners 20*ab*, which hold the pad in the desired position. This allows the shooter to not have to lower the head by raising the gun 14 and sighting device 15 in front of shooter's eye. The horizontal distance between the sighting bead 15 and the gun butt 4 is depicted 16*ab*. The elevated distance of the sighting bead above the adjustable stock is also depicted 17*ab*. The fastener 11 is the center point of rotation.

Figure 3:
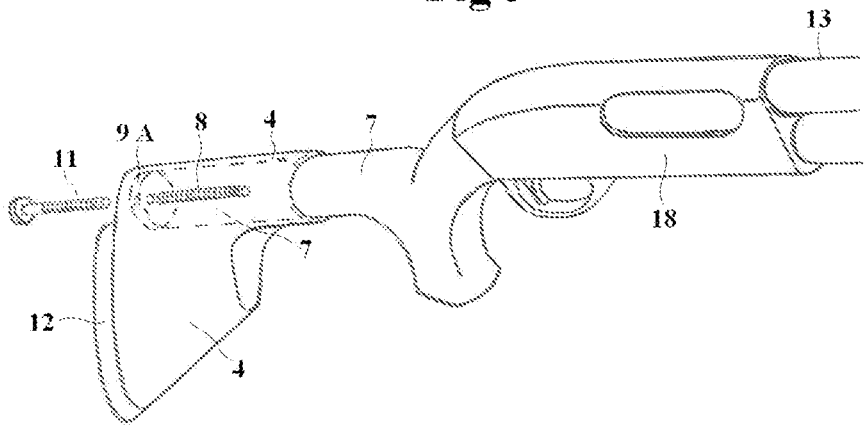
FIG. 3: side view of a shouldered firearm incorporating a sectional view of the adjustable stock, shown rotated to the right.

FIG. 3 depicts the side view of a shouldered firearm, including a sectional view of the second member of the adjustable gun butt 4. This view displays the first member of adjustable gun butt 7 and the spacer 9*a* for adjusting the stock length. It also displays the mechanism for fastening the stock in place once pivoted: the threaded opening for the fastener 8, and the fastener 11. The second member of the adjustable gun butt 4 houses the rearward portion of the first member of the adjustable gun butt 7. The forward portion of the first member of the adjustable gun butt 7 is fasted and fixed in place to the firing mechanism 18. The adjustable recoil shoulder pad 12 is displayed. Also pictured are the gun barrel 13 and the firing mechanism 18. In this picture the recoil shoulder pad 12 is fixed in place to the second member of the adjustable gun butt 4.

Figure 4:
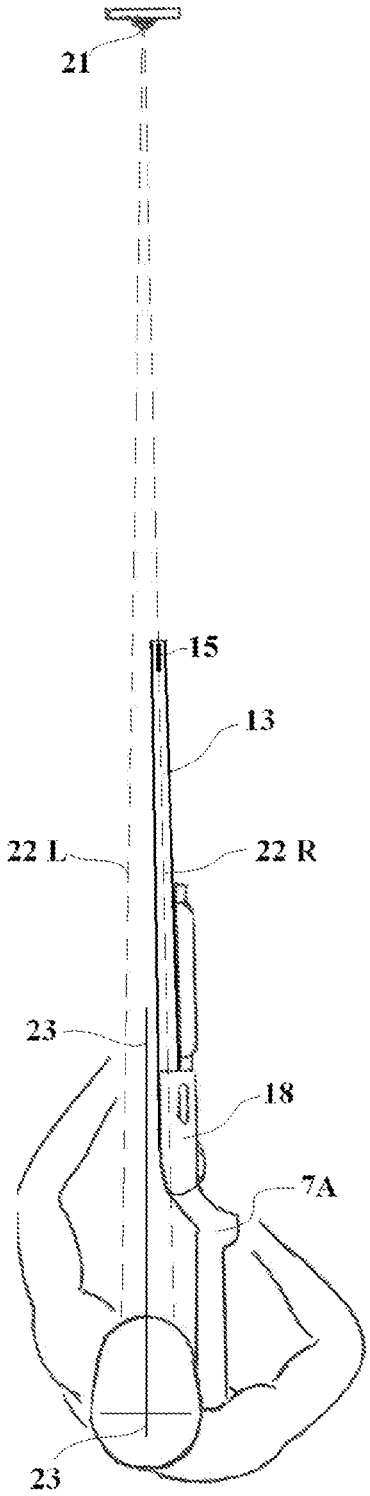
FIG. 4: a topical view of a shouldered firearm with a manufactured fixed stock, held in firing position. Shooter's head is perpendicular to the target and the firing mechanism and barrel are in front of shooter's eye

Displayed in FIG. 4 is a topical view of a shouldered firearm with a manufactured, fixed stock, held in firing position. The forward portion of the pivoted fixed stock 7*a* is fixed in the pivoted position. The center of the target 21 is aligned with the optical path of the left 22L and right 22R eyes. The shooter's head is substantially perpendicular to the target 23, and the firing mechanism 18, while the barrel 13, and sighting bead 15 are in front of the shooter's eye.

Figure 5:
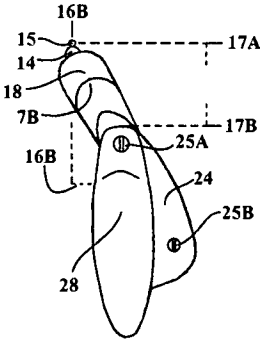
FIG. 5: rearview of after-market pivoting shoulder pad that has been pivoted to the left, showing the stock to be lower than the barrel, firing mechanism, and sighting device.

FIG. 5 depicts the after market pivoted recoil shoulder pad 28. The firing mechanism 18 has been pivoted to the left of the recoil shoulder pad 28, is substantially vertical and is in firing position. The sighting base 14, which is attached to upper portion of gun barrel 13 (visible in FIG. 6) and the adjustable sighting bead 15 which is attached to sighting base 14, is located to the left of recoil shoulder pad. It shows the offsetting of the sighting bead from the adjustable recoil shoulder pad 28. Additionally, 16*b* broken lines show the offsetting of the firing mechanism 18, sighting base 14, and sighting bead 15, as well as the elevated distance of the adjustable sighting bead 15 above the traditional gun butt.

7*b* and 17*ab* broken lines show the distance between the top of the adjustable recoil shoulder pad 28 and the adjustable sighting bead 15. Fastener 25*a* passes through the adjustable recoil shoulder pad 28 and the first member 24 and fastens into the traditional gun butt 7*b*. This secures the adjustable recoil shoulder pad 28 and the first member 24 to the traditional gun butt 7*b*, and it is the point of rotation for the adjustable recoil shoulder pad 28. The first member 24 is located between traditional gun butt 7*b* and the adjustable recoil shoulder pad 28. 25*b* is a fastener that travels through the first member 24 and fastens to traditional gun butt 7*b*, securing the first member 24 to the traditional gun butt 7*b*. This allows the user to shoulder the firearm and align the eye with the sighting bead without twisting or tilting head.

Figure 6:
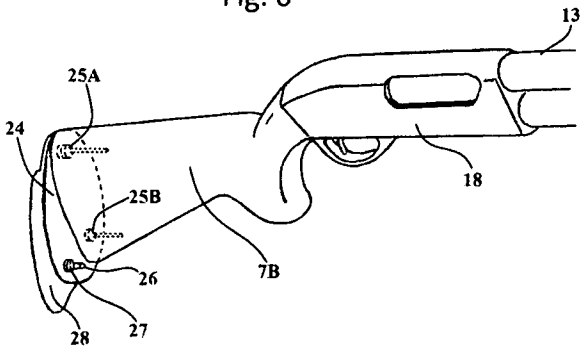
FIG. 6: side view of after-market pivoting shoulder pad incorporating a sectional view of the adjustable stock that has been pivoted to the right.
Figure 7:
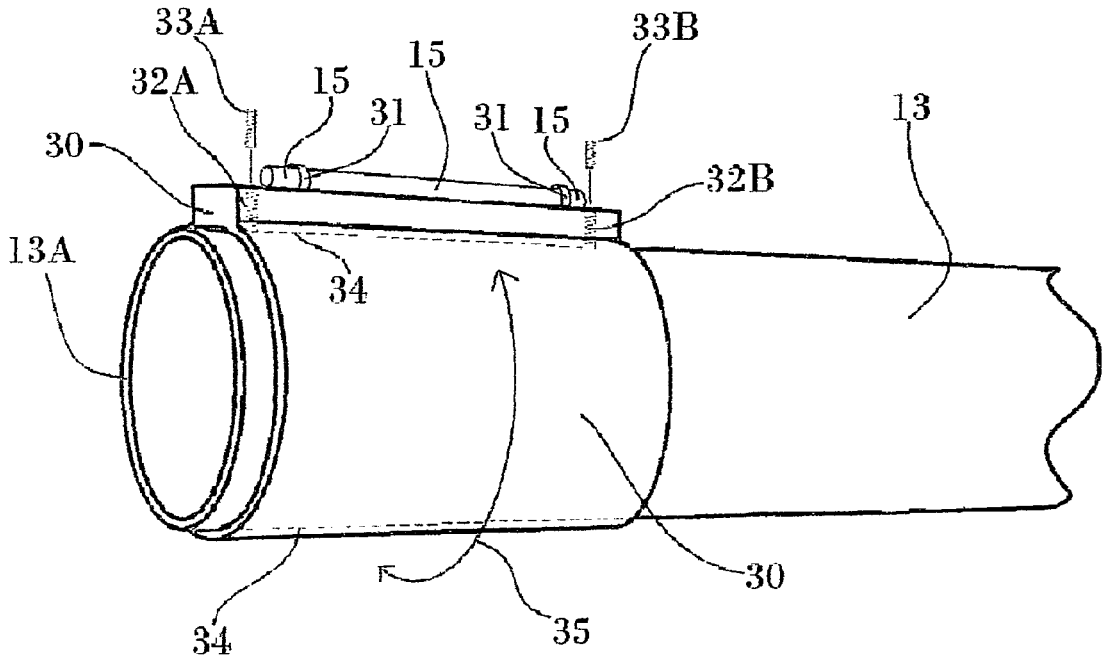
FIG. 7: side view of the rotating sighting base apparatus and the sighting bead mounted on the forward leading end of a firearm barrel.

Displayed in FIG. 6: the after market pivotal recoil shoulder pad 28 has been pivoted to the right, is substantially vertical and is in firing position. The firing mechanism 18 and the top of the gun barrel 13 have been pivoted and positioned to the right of the recoil shoulder pad 28. Fastener 25*a* has passed through the adjustable recoil shoulder pad 28, the first member 24 and is fastened to traditional gun butt 7*b*. This connects the recoil shoulder pad 28 and the first member 24 to the traditional gun butt 7*b*. Fastener 25*b* has traveled through the first member 24, is fastened to the traditional gun butt 7*b* and connects the first member 24 to the traditional gun butt 7*b*. 26 is an elongated opening in the first member 24, and fastener 27 passes through the elongated opening 26 and fastens to the adjustable recoil shoulder pad 28. When fastener 27 and fastener 25*a* are loosened, fastener 27 can be positioned at different places within the elongated opening 26 and tightened in desired position. Fastener 27 and fastener 25*a* can be tightened to secure the adjustable recoil shoulder pad 28 in different positions, thus allowing rotation adjustment of the adjustable recoil shoulder pad 28. This permits the user to shoulder the firearm and align the head with the sighting bead without twisting or tilting head.

FIG. 7

#13- firearm barrel

#13A- forward leading end of a firearm barrel

#30- rotating sighting base apparatus mounted on the forward leading end of a firearm barrel 13A

#34- broken lines show the inside diameter of rotating sighting base apparatus

#32- threaded openings in rotating sighting base apparatus 32A and 32B are openings in sighting base apparatus that receive fasteners 33A and 33B

#15- sighting bead

#31 A- fasteners that fasten sighting bead 15 to rotating sighting base apparatus

#31B- fasteners that fasten sighting bead 15 to rotating sighting base apparatus

#32A- threaded fasteners

#32B- threaded fasteners

#35- arrow showing rotation of sighting base apparatus around firearm barrel When threaded fasteners 33A and 33B are threaded into threaded openings 32A and 32B they can be tightened against the firearm barrel 13 securing sighting base apparatus 30 and sighting bead 15 in desired position. When 33A and 33B are loosened sighting bead 15 mounted upon the sighting base apparatus 30 may be rotated around the barrel 13 indicated by arrow 35.

Title? On a traditional shouldered firearm, the stock butt, firing mechanism, barrel and sighting mechanism are all aligned. This requires the movement of tilting and rotating the head to align the eye with the sighting mechanism in the gun mount. This additional movement and unnatural stance decrease accuracy in shooting.

The primary purpose of this invention is to allow the shooter of a shouldered firearm to align the eye with the sighting bead of a shouldered firearm without tilting or rotating the head. The stock of the gun pivots about an axis and is fastened in place, making room for the shooter's head where the stock of a traditional shouldered firearm would be, thereby allowing the shooter to maintain a head position substantially perpendicular to the target, and shoot more accurately. The sighting bead is also adjusted in accordance with the stock adjustment. This natural shooting position and the reduced requirement of head movement allow for greater accuracy. For even greater shooting accuracy, the invention contains shoulder pads, which adjust upward and downward to further customize the shouldered firearm to the shooter. The shooter can adjust the shoulder pad to align the eye with the sighting bead without having to lower the head. The stock also includes spacers between the gun butt and the stock, which allow for adjustment to the length of the stock.

The invention may also be created with the stock rotated about an axis and then fixed in place. This model also includes shoulder pads, which adjust upward and downward, and spacers to adjust the stock length.

The invention may also be an accessory to an existing shoulder firearm. This model includes a pivoting shoulder pad-extension for the stock as well as a rotating sighting bead attachment.

The invention claimed is:

1. A shoulder-fired firearm comprising:

a firing mechanism, a barrel, a sighting bead, a rotating stock butt, the rotating stock butt including a grip, a cheek weld and a recoil pad below the top longitudinal surface of the firing mechanism, barrel and sighting bead when the shoulder-fired firearm is in a horizontal firing position, all descriptions hereafter are written to this orientation;

the rotating stock butt, having a first and second member, which provides an axis for rotation, the axis substantially parallel with the barrel, the first member having a first leading end and a second trailing end and the grip, the first leading end fastens to a rearward trailing end of the firing mechanism, the second trailing end extends rearward from the firing mechanism, aligning substantially parallel with the firing mechanism and the barrel;

the second member of the rotating stock butt, having a first leading end and a second trailing end, a first upper portion and a second lower portion;

the first leading end and the first upper portion having an elongated opening that extends rearward from the first leading end reducing in size and exits out the second trailing end of the first upper portion of the rotating stock butt;

the second trailing end of the first member of the rotating stock butt is housed within the elongated opening of the second member of the rotating stock butt, and configured to allow rotation between the first and the second members of the rotating stock butt;

a series of removable spacers, having central openings, are placed in the elongated opening in the first upper portion of the second member of the rotating stock butt;

wherein a length of the rotating stock butt from the firing mechanism is determined by the number of the spacers used;

the second trailing end of the second member of the butt stock includes the recoil pad;

wherein the recoil pad is attached to the second trailing end of the second member of the rotating stock butt.

2. The shoulder-fired firearm of claim 1 further comprising:

a central elongated threaded opening in the second trailing end of the first member of the rotating stock butt.

3. The shoulder-fired firearm of claim 2 further comprising:

a threaded elongated fastener that passes through the reduced sized opening in the second trailing end of the second member of the rotating stock butt and fastens into the central elongated threaded opening;

wherein when the threaded elongated fastener is loosened it allows rotation of the first member of the rotating stock butt to rotate within the second member of the rotating stock butt;

when the threaded elongated fastener is tightened it secures the first member of the rotating stock butt to the second member of the rotating stock butt in a desired position.

4. The shoulder-fired firearm of claim 1 further comprising:

a central elongated threaded opening in the second trailing end of the first member of the rotating stock butt;

a series of removable spacers, having central openings, configured to allow lengthening and shortening of the rotating stock butt by being placed in the rearward portion of the elongated opening of the second member of the rotating stock butt;

wherein openings in the removable spacers align with the reduced opening in the second trailing end of the second member of the rotating stock butt and the elongated threaded opening in the second trailing end of the first member of the rotating stock butt and allow the threaded elongated fastener to pass through the reduced opening in second trailing end of the second member of the rotating stock butt through the central openings in the removable spacers and fasten into the elongated threaded opening of the second trailing end of the first member of the rotating stock butt.

5. The shoulder-fired firearm of claim 1 further comprising:

a sighting base apparatus having an elongated opening that allows the sighting base apparatus to circumference a forward leading end of the barrel and can be rotated 360 degrees around the perimeter of the forward leading end of the barrel.

6. The shoulder-fired firearm of claim 5 further comprising:

a sighting bead mounted on the sighting base apparatus which is held in place by a selected number of fasteners that fasten the sighting bead to the sighting base apparatus.

7. The shoulder-fired firearm of claim 6 wherein:

the rotating stock butt including the grip, the cheek weld and the recoil pad below the top longitudinal surface of the firing mechanism and the barrel including the sighting base apparatus when the shoulder-fired firearm is in the horizontal firing position;

orientation of adjustment between the rotating stock and the rotating sighting apparatus begins with the vertical alignment of the recoil pad, the cheek weld of the rotating stock butt, the firing mechanism and the barrel, and the sighting bead of the sighting base apparatus when the shoulder-fired firearm is in horizontal firing position;

the second member of the rotating stock butt, including the recoil pad, remains in vertical alignment;

when the first member of the rotating stock butt, the firing mechanism and the barrel rotate the desired number of degrees to the right, the sighting base apparatus rotates around the barrel substantially the same number of degrees to the left placing the sighting bead of the rotating sighting base apparatus substantially vertically centered above the barrel of the shoulder-fired firearm;

the second member of the rotating stock butt, including the recoil pad, remains in vertical alignment;

when the first member of the stock butt, the firing mechanism and the barrel rotate the desired number of degrees to the left, the sighting apparatus rotates around the barrel substantially the same number of degrees to the right placing the sighting bead of the rotating sighting base apparatus substantially vertically centered above the barrel of the shoulder-fired firearm.

8. The shoulder-fired firearm of claim 5 further comprising:

a series of threaded openings in the sighting base apparatus of the shoulder-fired firearm.

9. The shoulder-fired firearm of claim 8 further comprising:

fasteners that pass through the series of threaded openings configured to tighten against the barrel and hold the sighting base apparatus and the sighting bead in a desired position.

* * * * *